US006089916A

United States Patent [19]

Kuo

[11] Patent Number: 6,089,916

[45] Date of Patent: Jul. 18, 2000

[54] CABLE ASSEMBLY CONNECTOR

[75] Inventor: Peter Kuo, Chung-Ho, Taiwan

[73] Assignee: Hon Hai Precision Ind. Co., Ltd., Taipei Hsien, Taiwan

[21] Appl. No.: 09/387,169

[22] Filed: Aug. 31, 1999

[30] Foreign Application Priority Data

Dec. 31, 1998 [TW] Taiwan ..... 87222084

[51] Int. Cl.[7] ..... H01R 13/648

[52] U.S. Cl. ..... 439/610

[58] Field of Search ..... 439/610, 939, 439/609, 465

[56] References Cited

U.S. PATENT DOCUMENTS 5,195,909 3/1993 Huss, Jr. et al. ..... 439/610
5,244,415 9/1993 Marsilio et al. ..... 439/610
5,380,223 1/1995 Marsh et al. ..... 439/610
5,667,407 9/1997 Frommer et al. ..... 439/610
5,836,774 11/1998 Tan et al. ..... 439/610

*Primary Examiner*—Gary F. Paumen
*Attorney, Agent, or Firm*—Wei Te Chung

[57] ABSTRACT

A cable assembly connector includes a housing, a shell unit and a cover unit. The housing has a circuit plate for receiving terminals of a cable, a mating frame, and a pair of supporting portions formed on opposite lateral sides thereof. The cover unit has a first and second covers. A plurality of projections is formed on inner surfaces of the first and second covers proximate an engaging port. A pair of grounding plates respectively extends perpendicularly from an edge of the first and second cover proximate a receiving space thereof. A plurality of protrusions is formed on the grounding plate for electrically contacting a metal shell of a mating connector and for grounding static electricity accumulated thereon.

1 Claim, 5 Drawing Sheets

CABLE ASSEMBLY CONNECTOR

BACKGROUND OF THE INVENTION

The present invention relates to a cable assembly connector, and particularly to a cable assembly connector for providing a reliable connection between a shell and a cover and a reliable grounding path for mating connectors.

Taiwan Patent Application No. 84201894 discloses a conventional cable assembly connector for interconnecting two electrical devices. The conventional cable assembly connector has a metal shell for providing shielding from EMI attached to an insulative housing retaining a plurality of terminals therein. For securing the metal shell to an outer cover while the cable assembly connector engages with a mating connector, the conventional cable assembly connector has a locking element formed in a side wall of the metal shell for engaging with a corresponding locking hole formed in the outer cover. In another conventional engagement configuration, a plurality of locking holes is formed on the metal shell for engaging with corresponding projections formed on the outer cover. Since the cable assembly connector is frequently inserted/withdrawn with a mating connector, the metal shell may become deformed and the outer cover can not be properly secured in position. Thus, the conventional cable assembly connector can not provide a reliable engagement between the metal shell and the outer cover. Furthermore, the metal shell of the conventional cable assembly connector does not have a grounding element for grounding static electricity, thus, signal transmission will be adversely affected by static electricity.

BRIEF SUMMARY OF THE INVENTION

A main object of the present invention is to provide a cable assembly connector having a plurality of projections for engaging with corresponding openings of a housing to secure the housing and a metal shell in position.

Another object of the present invention is provide a cable assembly connector having a plurality of grounding protrusions for grounding static electricity accumulated on a mating connector and ensuring reliable signal transmission.

To fulfill the above mentioned objects a cable assembly connector comprises a cover unit, a shell unit and a housing. The cover unit has first and second covers. The first and second covers respectively define first and second receiving spaces for receiving a mating electrical connector. A pair of projections is formed in inner surfaces of the cover proximate an engaging port. The shell unit comprises a first and second shells, and a pair of grounding plates is perpendicularly extends outward from an edge of the first and second shells proximate a receiving space thereof. A plurality of protrusions is formed on the grounding plate for electrically contacting a metal shell of a mating connector thereby grounding static electricity accumulated on the mating connector.

Other objects, advantages and novel features of the invention will become more apparent from the following detailed description when taken in conjunction with the accompanying drawings.

DETAILED DESCRIPTION OF THE INVENTION

Figure 1:
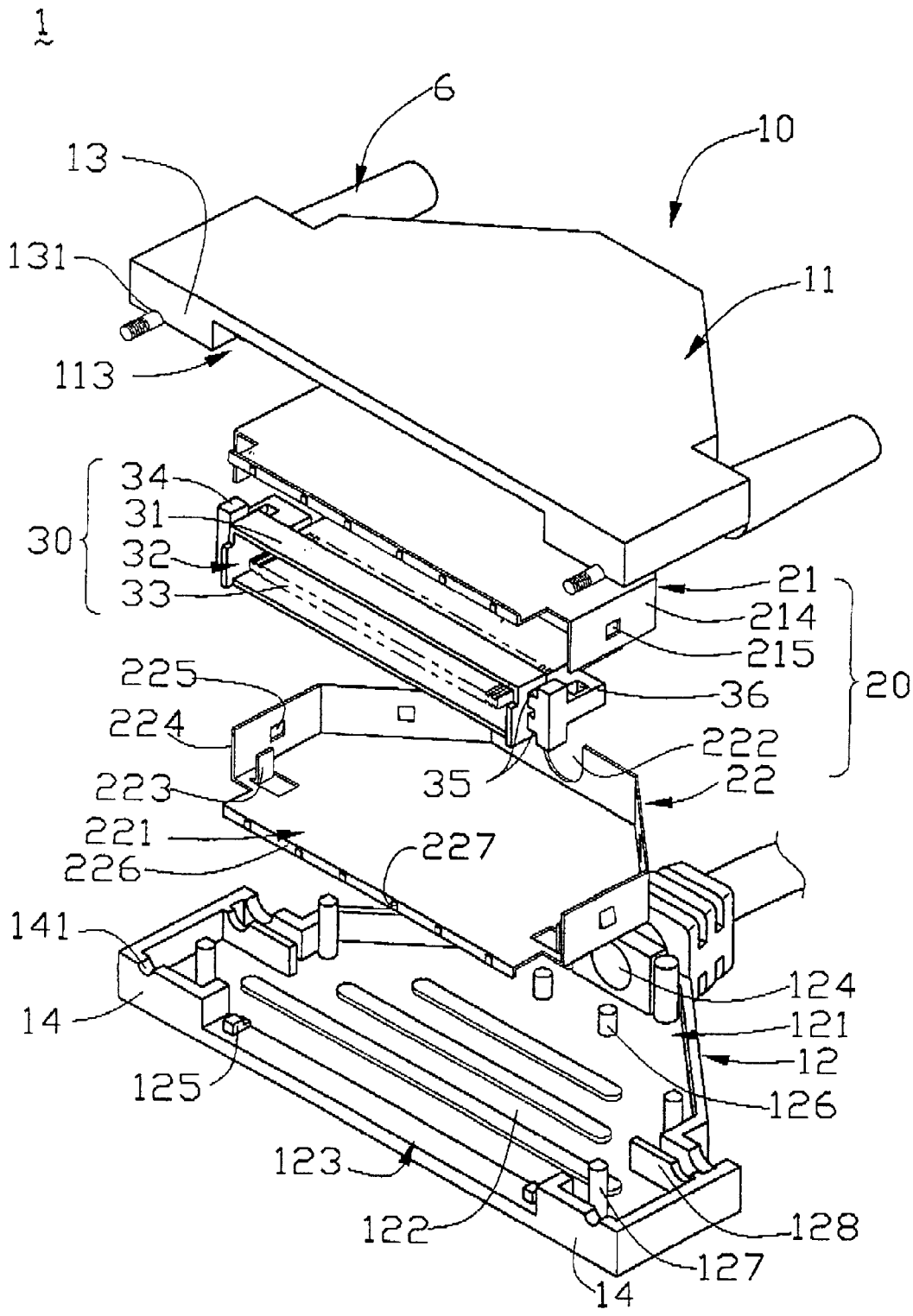
FIG. 1 is an exploded view of a cable assembly connector in accordance with the present invention.
Figure 3:
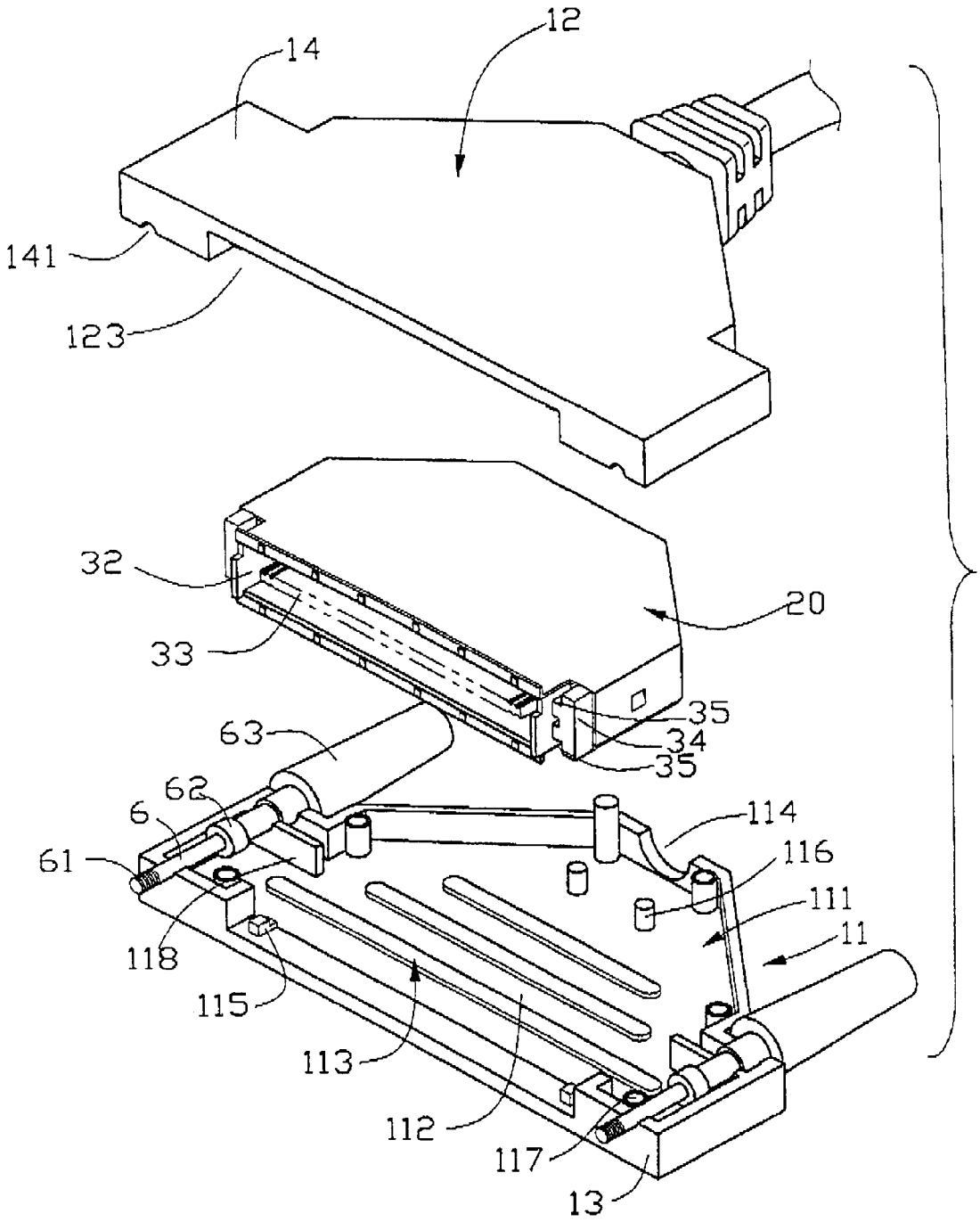
FIG. 3 is a partially assembled view of the cable assembly connector of FIG. 1 taken from a different perspective.

Referring to FIGS. 1 and 3, a cable assembly connector 1 comprises a cover unit 10, a shell unit 20 and a housing 30. The cover unit 10 has first and second covers 11, 12. The first and second covers 11, 12 define a first and second receiving spaces 111, 121, respectively. At a front side of the cover unit 10, the first and second covers 11, 12 each define an engaging port 113, 123, and receiving holes 114, 124 are formed in a rear side of the cover unit 10. A plurality of projections 115, 125 are formed on inner surfaces 112, 122 of the first and second covers 11, 12 proximate the engaging ports 113, 123. A plurality of positioning poles 116, 126 are formed on the inner surfaces 112, 122 proximate the receiving holes 114, 124 for properly positioning the shell unit 20. A plurality of posts 127 is formed on the inner surface 122 of the second cover 12. A plurality of corresponding holes 117 is formed in the first cover 11 for engaging with the posts 127 and securing the first and second covers 11, 12 together. Shoulders 13, 14 are respectively formed on the first and second covers 11, 12 proximate opposite lateral sides of the engaging ports 113, 123, and recesses 131, 141 are formed on the shoulders 13, 14. Vertical walls 118, 128 are formed in the inner surfaces of 112, 122 opposite the shoulders 13, 14.

Figure 2:
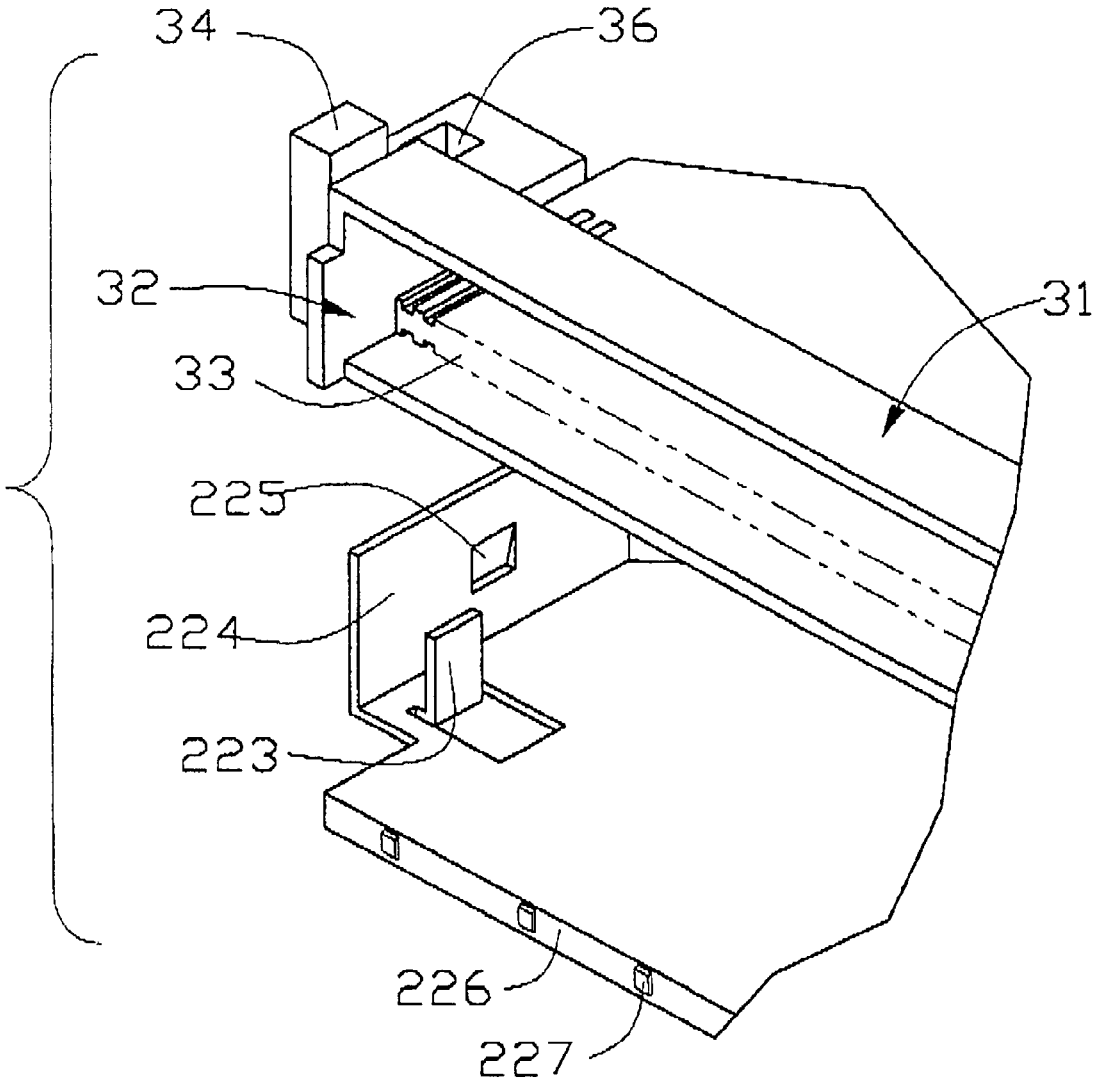
FIG. 2 is a partial view of FIG. 1.
Figure 4:
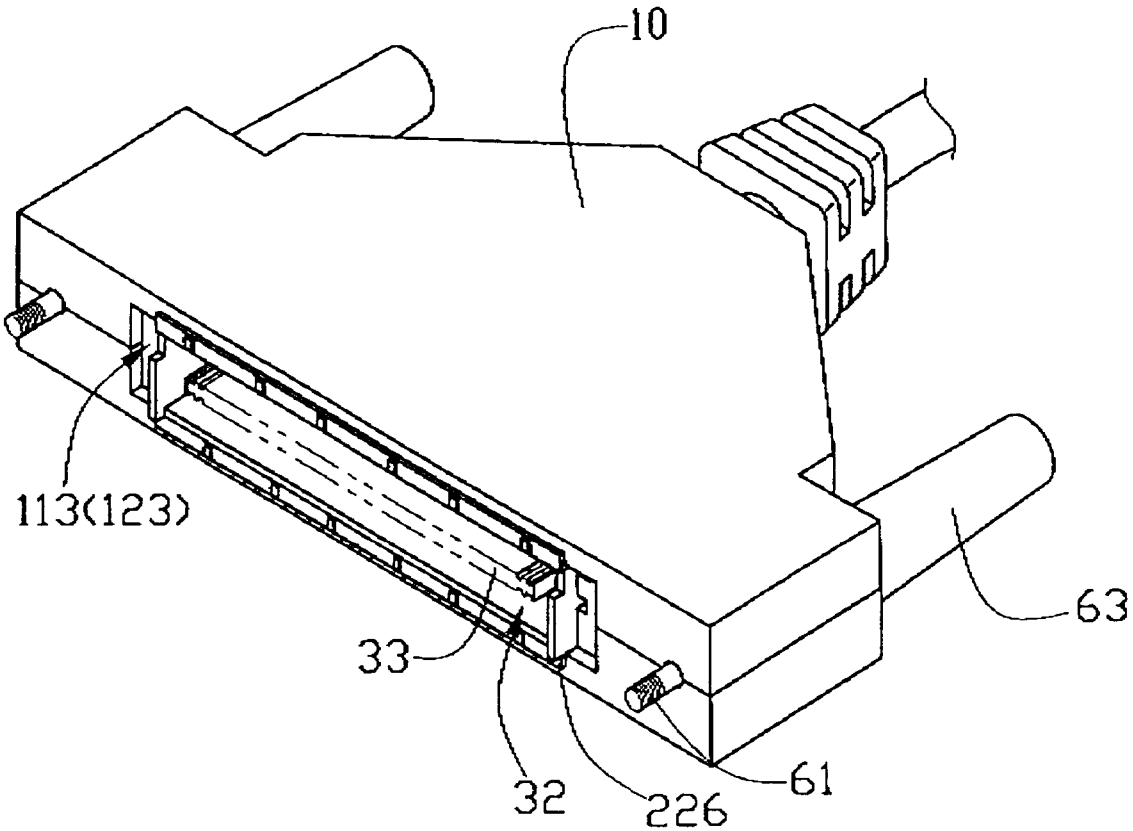
FIG. 4 is an assembled view of FIG. 3.

Referring to FIGS. 1 and 2, the shell unit 20 comprises first and second shells 21, 22. A receiving space 221 is formed in a front side of the second shell 22 and an opening 222 is formed in a rear side of the second shell 22 for receiving a cable (not shown) therein. In this invention a grounding wire of a cable is soldered to the shell unit 20 proximate the opening 222 for grounding static electricity. A pair of grounding plates 226 respectively extends perpendicularly from an edge of the first and second shells 22 proximate the receiving space 221. The grounding plates 226 respectively engage with upper and lower edges of the second cover 22 proximate the engaging port 123 (FIG. 4). A plurality of protrusions 227 is formed on the grounding plate 226 for electrically contacting a metal shell of a mating connector (not shown) and grounding static electricity accumulated on the mating connector. A plurality of locking plates 225 is formed on a side wall 224 of the second shell 22 for engaging with corresponding locking holes 215 formed in a first side wall 214 of the first shell 21, thus, the first shell 21 is assembled to the second shell 22.

The housing 30 has a mating frame 31 defining a receiving slot 32. A plurality of terminals is positioned in a circuit plate 33 received in the receiving slot 32 for electrically contacting the mating connector. A pair of supporting portions 34 is formed on opposite lateral sides of the mating frame 31, and a pair of notches 35 is formed in opposite sides of each supporting portion 34 for engaging with the projections 115, 125 of the cover unit 10. The folded plates 223 is formed on an inner surface of the second shell 22 proximate the receiving space 221 for engaging with corresponding positioning holes 36 for securely fixing the housing 30 in the shell unit 20.

Figure 5:
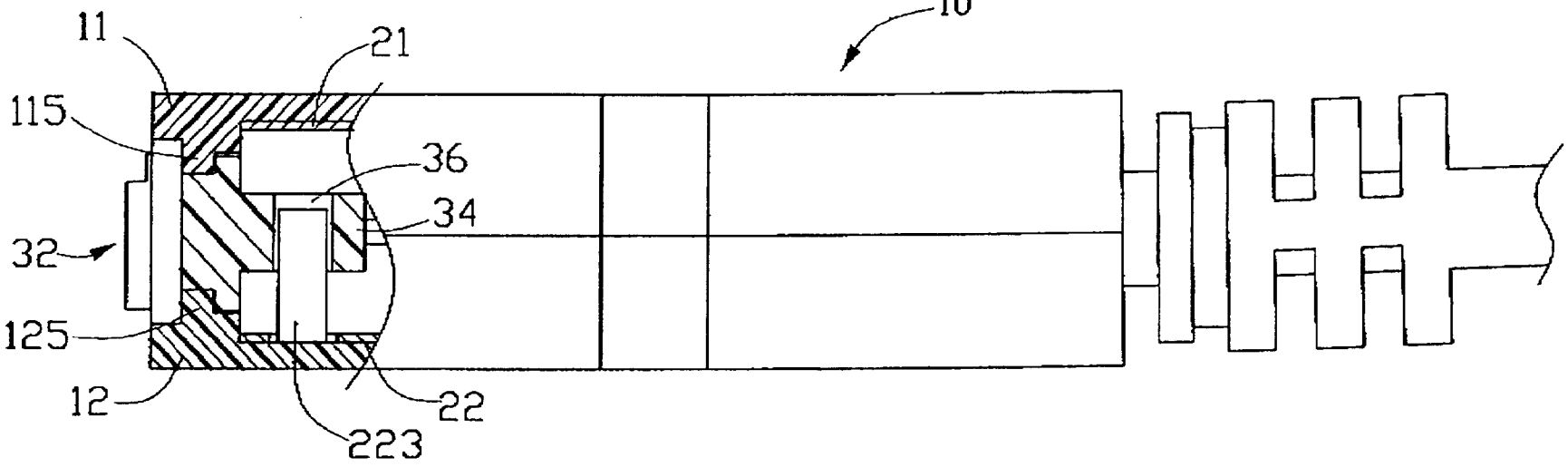
FIG. 5 is a partial, cross-sectional view of FIG. 4.

Referring to FIGS. 1 and 3, a pair of screws 6 is mounted in the recesses 131 of the shoulders 13. When the first and second covers 11, 12 are assembled together, the recesses 131, 141 align to form a hole for securely positioning the screw 6 in the cover unit 10. A screw thread 61 is formed at an end of the screw 6, a shoulder portion 62 is formed around a middle section of the screw 6, and an insulative bar 63 is formed at an opposite end for driving the screw 6. Each screw 6 is received in the corresponding recesses 131 and the shoulder portion 62 is positioned between the vertical wall 118 and the shoulder 13. Each screw 6 is inserted into a corresponding receiving hole of the mating connector for securely fixing the connector 1 thereto and for ensuring reliable signal transmission and grounding of the connectors. The folded plates 223 of the shell unit 20 engage with the corresponding positioning holes 36 of the housing 30 and the projections 115, 125 of the cover unit 10 engage with the notches 35 of the housing 30 (FIG. 5). Thus, the housing 30 is securely mounted in the shell unit 20 and the cover unit 30. Furthermore, the protrusions 227 of the grounding plate 226 electrically contact a metal shell of the mating connector for grounding static electricity accumulated thereon and the screw 6 provides a reliable connection between the mating connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly connector for connecting with a mating connector, comprising:

a housing having a mating frame, a pair of supporting portions on opposite lateral sides of the mating frame, and a pair of positioning holes formed at the lateral sides;

a shell unit including first and second metal shells assembled together for enclosing the housing, the first and second shells defining a receiving space, a pair of grounding plates respectively extending from the first and second shells, a plurality of protrusions being formed on each grounding plate for electrically contacting the mating connector, a pair of folded plates being formed on an inner surface of the second shell for being received in corresponding ones of the positioning holes; and a cover unit including first and second covers assembled together for receiving the assembled shells, the first and second covers defining an engaging port for receiving the mating connector, a pair of projections being formed on an inner surface of the engaging port for engaging with the supporting portions of the housing;

wherein each supporting portion defines a pair of notches in upper and lower surfaces thereof for engaging with the projections of the cover unit;

wherein the positioning holes receive therein the folded plates for securely fixing the housing in the shell unit;

wherein the second shell forms a second side wall perpendicularly extending therefrom proximate the receiving space, a pair of locking plates being formed on the second side wall for being received in corresponding locking holes formed in a first side wall of the first shell.

* * * * *